United States Patent [19]

Savage et al.

[11] Patent Number: 4,838,762

[45] Date of Patent: Jun. 13, 1989

[54] FAN BODY AND ROTOR CUP ASSEMBLY

[75] Inventors: Jack W. Savage, Centerville; Lloyd L. Kuck, Beavercreek, both of Ohio

[73] Assignee: General Motors Corporation, Detroit, Mich.

[21] Appl. No.: 179,691

[22] Filed: Apr. 11, 1988

[51] Int. Cl.[4] ..... F04D 29/20

[52] U.S. Cl. ..... 416/187; 416/178; 416/241 A

[58] Field of Search ..... 416/187, 24 A, 178, 416/134 R

[56] References Cited

U.S. PATENT DOCUMENTS

| | | | |
|---|---|---|---|
| 1,876,518 | 9/1932 | Mathis | 416/187 X |
| 2,299,010 | 10/1942 | Doman | 416/134 R X |
| 2,987,172 | 6/1961 | Linsenmeyer | 416/187 |
| 3,264,016 | 8/1966 | Reisch | 416/134 R |
| 3,407,882 | 10/1968 | Wooden et al. | 416/134 R |
| 3,521,973 | 7/1970 | Schouw | 416/241 A X |
| 3,536,416 | 10/1970 | Glucksman | 416/178 |
| 3,567,335 | 3/1971 | David et al. | 416/134 R |
| 3,635,588 | 1/1972 | Lester et al. | 416/187 |
| 3,811,978 | 5/1974 | Wooden | 416/187 X |
| 3,952,712 | 4/1976 | Hermanson | 416/241 A X |

FOREIGN PATENT DOCUMENTS

| | | | |
|---|---|---|---|
| 1957988 | 6/1971 | Fed. Rep. of Germany | 416/178 |
| 2159932 | 6/1973 | Fed. Rep. of Germany | 416/187 |
| 876618 | 9/1961 | United Kingdom | 416/187 |
| 2041102 | 9/1980 | United Kingdom | 416/134 R |

*Primary Examiner*—Everette A. Powell, Jr.
*Attorney, Agent, or Firm*—Charles R. White

[57] ABSTRACT

This fan cage is formed from a plastics material and locking, locator and drive devices integral with the cage and extend from one edge thereof into a "snap fit" connection with a motor driven rotor plate. With this construction, the fan cage can be readily removed from the rotor plate for inspection and replacement as required.

6 Claims, 2 Drawing Sheets

FAN BODY AND ROTOR CUP ASSEMBLY

FIELD OF INVENTION

This invention relates to fluid handling fans and more particularly to a new and improved fan body and rotor cup assembly featuring a torque transmitting body cup connection with a "snap in" axial lock which also provides an anti-lash and cushioned drive. The connection provided by this invention automatically centers and releasably secures the fan body to the cup in a dynamically balanced position without requiring special tooling or fixtures.

DESCRIPTION OF RELATED ART

Centrifugal fans such as those used in ventilation systems in automobiles often employ a bladed "squirrel cage" body of plastics material joined at one side to a dish-like rotor cup sheet metal which supports the body and provides a drive input from a direct current motor. The drive motor, mounted to a suitable support, has a centralized and axially extending support shaft that, through a suitable bearing arrangement, rotatably supports the fan body and allows it to be driven at varying speeds by the motor. An illustrative centrifugal fan construction is disclosed in U.S. Pat. No. 4,659,951, issued Apr. 21, 1987 to D. F. Angi et al entitled Brushless Blower With Load Proportional Cooling For Control Circuitry, assigned to the assignee of this invention and hereby incorporated by reference. The fan body of such construction, molded from a selected plastics material, has a circle of integral projections that extend axially from one side thereof to go through matching openings in a peripheral flange of a sheet metal rotor cup. By hot upsetting the ends of these projections, using special fixtures and tooling, a locking head is formed on the outboard side of the flange to couple the rotor cup to the fan body. With such attachment, a permanent assembly of these two components is obtained which meets torque requirements for rotational drive in either direction with long service life. The initial assembly, however, requires complex and costly tooling and the viscous and sticky waste materials produced from hot upsetting the projections are difficult to control, handle, and clean. If repair or inspection is necessary, removal of the fan body from the rotor cup generally results in damage or destruction of the fan body.

SUMMARY OF THE INVENTION

In contrast to the prior construction, the present invention provides a new and improved torque transmitting drive connection and "snap in" axial lock means between the fan body and the rotor cup. The drive connection and locking means are integral with the fan body and project axially from one side thereof to correspond to retainer openings in the rotor cup. These drive connectors and retainers are arranged in a circular pattern to compass the rotational axis of the fan body. The "snap in" locking means are formed by pairs of spring fingers diverging from points of connection with the fan body to terminal camming heads. When the fan body is axially installed onto the rotor cap, the camming heads contact the side edges of the openings in the rotor cup so that the fingers are forced together until the heads are through the openings. At such position, the fingers will spring apart to effect the axial locking of the fan body to the rotor cup. These spring fingers importantly provide a yieldable anti lash torque transmitting connection between the fan body and the rotor cup. In the event of high torque loads, the fingers deflect to cushion the engagement of drive components that extend through the rotor cup openings. The spring fingers can, when necessary, be moved toward one another to release the fan body from the rotor cup for fan body inspection and repair.

With the precise location of the fan body on the rotor cup as provided by this invention, there is inherent control of fan body to rotor cup concentricity and resulting dynamic balance of the assembly. Furthermore, with this invention there is improved torsional strength of the fan and rotor cup assembly since each connection includes fixed locator and drive components which are identical and are not subject to variances that may result from a hot upset connection. This invention further provides for the quick assembly of the fan body to rotor cup without special tooling and for fan rotation in either direction without lash.

These and other features, objects and advantages of this invention will become more apparent from the following detailed description and drawing in which.

Figure 1:
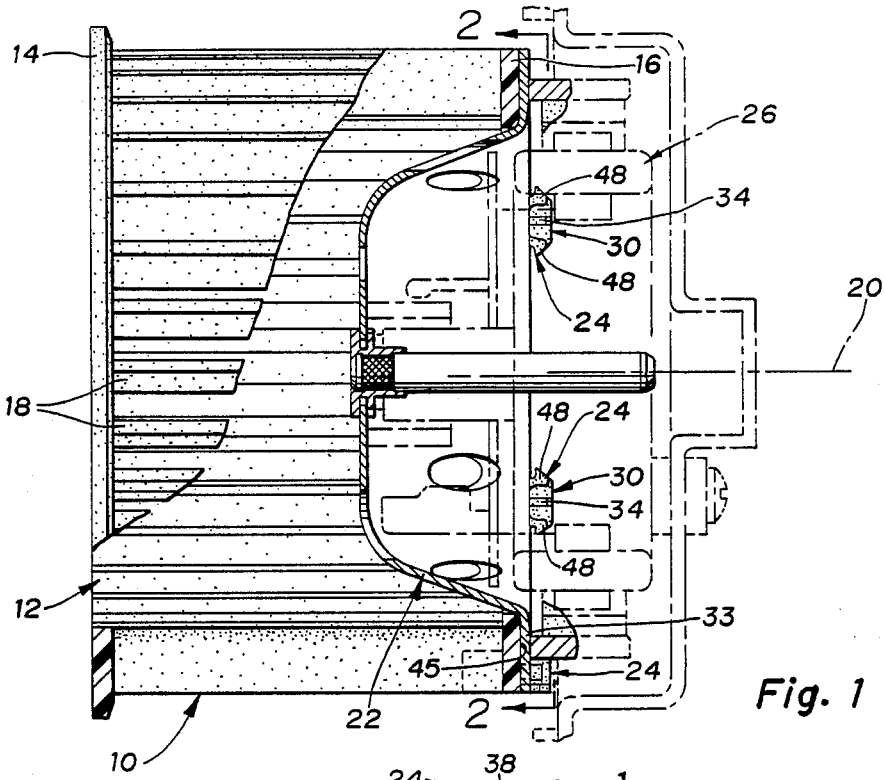
FIG. 1 is a side sectional view partially in elevation of a centrifugal fan body and rotor cup assembly taken generally along line 1—1 of FIG. 2.
Figure 2:
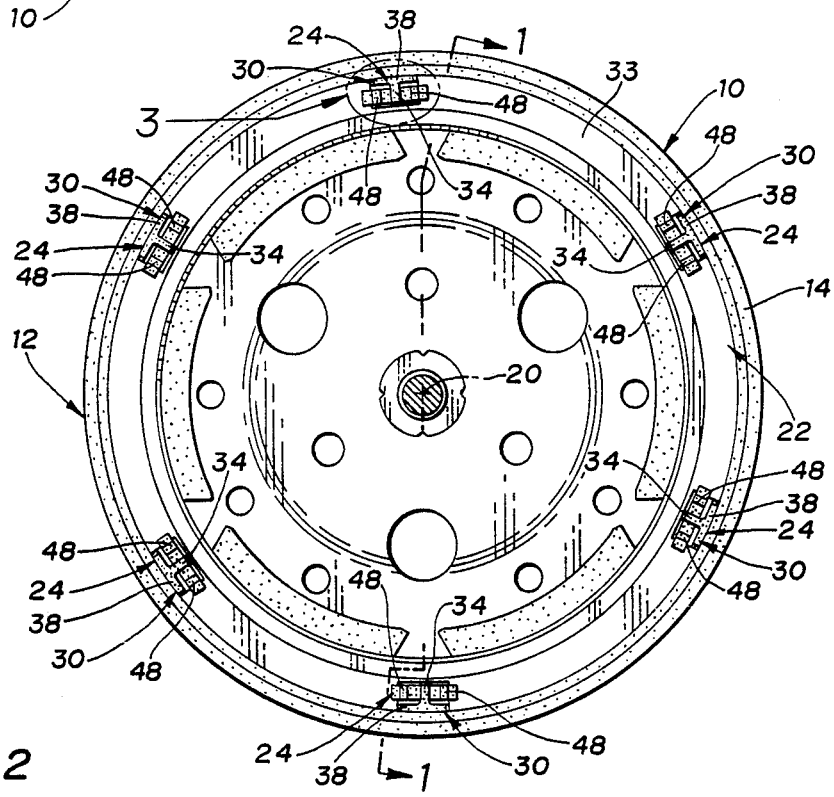
FIG. 2 is an end view of the assembly of FIG. 1 taken generally along lines 2—2 of FIG. 1.
Figure 3:
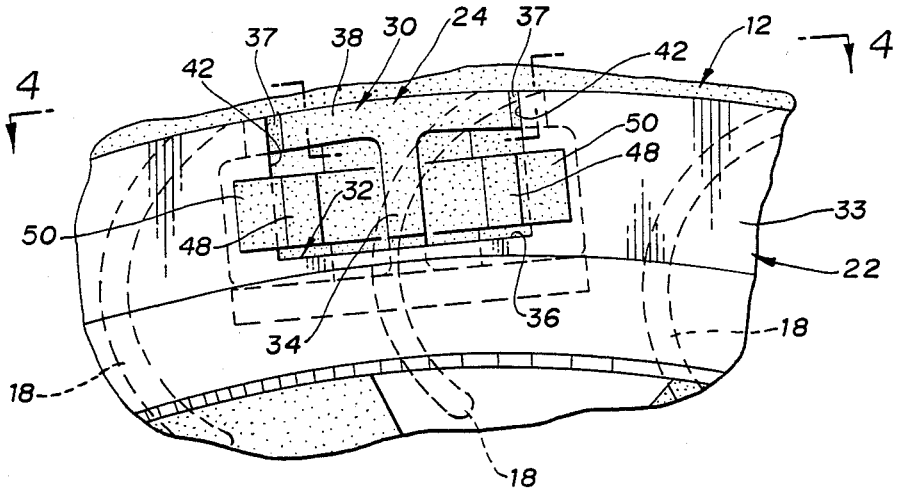
FIG. 3 is an enlarged view of a portion of FIG. 2 which is encircled by the dashed line and is identified by numeral 3.
Figure 4:
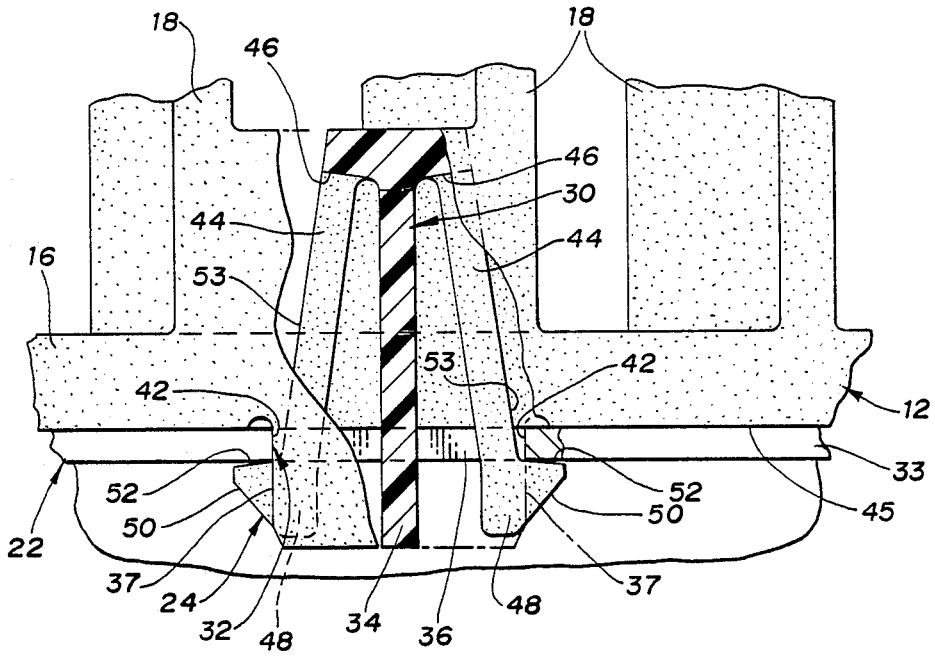
FIG. 4 is a top plan view of FIG. 4 with parts broken away taken generally along lines 4—4 of FIG. 3.

Turning now in greater detail to the drawing, there is shown in FIG. 1 a centrifugal fan and rotor cup assembly 10 comprising a one-piece fan body 12 molded from a glass-filled polypropylene or other suitable plastics materials. This fan body is frequently referred to as a "squirrel cage" unit that has laterally spaced sides 14 and 16 which are interconnected by a plurality of elongated air foils or blades 18 which are equally spaced from each other and are arranged in a circular pattern to encompass the axis of rotation 20. A drive plate formed by a sheet metal rotor cup 22 is secured to one side of the fan body by special "snap in" locks and drive connections 24 described in detail below to provide the drive input from a DC motor 26 shown in phantom lines for driving the fan about rotational axis 20 as more fully described in the above-referenced U.S. Pat. No. 4,659,951. As best shown in FIGS. 2, 3 and 4, the equally spaced "snap in" drive connector and locks 24 are identical and are molded integrally with the fan body and extend laterally from the side 16 thereof. More particularly, each "snap in" drive connector and lock 24 comprises an axially extending locator and drive component 30 T-shaped in cross-section, see FIG. 3, that projects through a corresponding inwardly extending opening 32 formed in the peripheral flange 33 of the rotor cup 22. The radial and inwardly extending leg 34 of the locator and drive component 30 seats on the bottom edge 36 of the opening 32 while the opposite side edges 37, 37 of the top leg 38 are capable of driving contact with the laterally spaced side edges 42, 42 of opening 32. With such construction, the fan body and rotor cup are on center, and have a good dynamic balance. It will be understood that sufficient clearances are provided between the contact surfaces of the locator and drive components 30 and the edges and sides of openings 32 to facilitate the assembly. Any torsional lash that might occur between the side edges 42, 42 defining opening 32 and the side edges of the top leg 38 will be taken up by the spring interconnection between the fan body and rotor cup described.

In addition to the locator and drive components 30, each drive connector and lock 24 has a pair of diverging spring legs 44 that extend from integral spring hinge connection 46 with portions of the fan body 30 alongside of the center leg 34 of the locator and drive component 30 as best shown in FIGS. 3 and 4. The terminal end of each leg 44 is formed as a hook shaped head 48 with an inclined camming surface 50 that engages the side edges 42 of the opening 32 when the fan body is displaced axially and the drive connector and snap in locks are inserted into the openings 32. This insertion will effect the deflection of the legs 44, 44 toward one another until the side surfaces 45 engage the adjacent surface of rotor cup flange 33 and the edges 42 of the flange openings 32 are cleared by the heads 48. After this station is passed, spring action will bias the legs to their FIG. 4 locking position in which inner locking edge 52 of each head engages the outer side of the rotor cup and outboard drive surfaces 53 of the spring legs contact the edges 42 of the openings 42 for an assured drive without lash. With the flange 33 of the rotor cup thus trapped, the fan body 12 is secured axially and torsionally to the rotor cup and can be driven in either direction without lash. On high torque loads, the spring fingers defect to cushion the positive drive provided by the engagement of the side edges 37 of the top legs 38 with side edges of the openings 42. This spring finger construction accordingly reduces wear on the positive drive and the positive drive prevents the over deflection of and damage to the spring fingers.

In the event the fan body needs to be removed from the rotor cup, the spring fingers 44, 44 are readily moved toward one another using simple hand tools so that the locking heads 48 clear openings 32 thereby allowing the fan cage to be axially removed from the rotor cup. This easy on and off connection can be accomplished without destruction of the fan body allowing inspection and servicing as necessary.

While a preferred embodiment has been shown and described, other embodiments will be apparent. Accordingly, the scope of the invention to cover the preferred and other embodiments of this invention is set forth in the following claims.

The embodiments of the invention in which an exclusive property or privilege is claimed are defined as follows:

1. A bladed fan body and rotor cup assembly adapted to be driven about an axis of rotation by motor means disposed to one side of said assembly comprising:

(a) a fan cage of plastics material having first and second sides laterally spaced from one another and interconnected by a plurality of transversely extending blades disposed in a predetermined pattern about said axis for pumping fluid in paths through said cage, (b) a side plate disposed adjacent to a first of said sides of said cage, said side plate having a plurality of openings formed therein and defined by inner and laterally spaced edges disposed at predetermined points around said axis, and (c) locator and fastener means extending laterally from said first of said sides through said side plate openings, said locator and fastener means being formed as an integral part of said cage and having a (i) radially inward fixed locator arm for direct contact with said inner edge of said opening, said locator arm having side edges spaced apart a distance less than said spaced edges of said opening, and (ii) a pair of fastener legs having spring hinge connection with said cage and extending through said opening into releasable connection with the outer side of said plate.

2. A bladed fan assembly adapted to be driven about a transverse axis by a motor means comprising:

(a) a fan cage of plastic materials having first and second sides laterally spaced from one another and interconnected by a plurality of transversely extending blades in a predetermined pattern around the axis for pumping air therethrough, (b) a rotor cup for driving said cage, said rotor cup having openings therethrough defined by drive edges, and (c) a plurality of fastener means integral with said fan cage for operative connection to said rotor cup at points about said axis complementary to said openings, each fastener means comprising (i) fixed drive means extending through said opening, fixed drive means including side edges spaced apart a distance less than said rotor cup drive edges, and (ii) a pair of spring legs extending from hinged connection with said cage and providing a resilient drive connection for cushioning the positive drive between said fan cage and drive edges of said openings.

3. The bladed fan body and rotor cup assembly as specified in claim 1 wherein each fastener leg includes a head having a cam surface for urging each leg toward said locator arm when said fastener means is initially extended through said openings.

4. The bladed fan assembly as specified in claim 2 wherein each spring leg includes a cam surface for urging each leg toward said fixed drive means when said fastener mean is initially extended through said openings.

5. A method of releasably locking a fan adjacent to a drive plate adapted to be driven by a motor means, comprising the steps of:

(a) providing a plurality of openings in the drive plate, each opening including driving edges;

(b) providing a plurality of fastener means extending from the fan body, each fastener means spaced complementary to a respective drive plate opening and comprising:

(i) a locator for projecting through a respective drive plate opening, the locator including side edges for driving contact with the drive plate, wherein the side edges are spaced apart a distance less than the distance between the driving edges, and (ii) a pair of driving spring legs extending from an integral spring hinge connection alongside the locator, each spring leg including a head for engaging a respective drive plate receiving edge;

(c) urging each pair of spring legs toward their respective locator; and (d) inserting each fastener means into a respective drive plate opening until the head of each spring leg is engaged against a respective receiving edge to releasably engage the fan to the drive plate.

6. The method as specified in claim 5 including the step of providing a cam surface on each spring leg head to urge each pair of spring legs toward their respective locator as each fastener means is inserted into a respective drive plate opening.

* * * * *